US007518468B2

(12) United States Patent
Matsunaga

(10) Patent No.: US 7,518,468 B2
(45) Date of Patent: Apr. 14, 2009

(54) POWER DIVIDER-COMBINER CIRCUIT

(75) Inventor: Kohji Matsunaga, Tokyo (JP)

(73) Assignee: NEC Corporation, Tokyo (JP)

( * ) Notice: Subject to any disclaimer, the term of this patent is extended or adjusted under 35 U.S.C. 154(b) by 172 days.

(21) Appl. No.: 10/559,101

(22) PCT Filed: May 28, 2004

(86) PCT No.: PCT/JP2004/007739

§ 371 (c)(1),
(2), (4) Date: May 16, 2006

(87) PCT Pub. No.: WO2004/109843

PCT Pub. Date: Dec. 16, 2004

(65) Prior Publication Data

US 2006/0279378 A1 Dec. 14, 2006

(30) Foreign Application Priority Data

Jun. 3, 2003 (JP) ..... 2003-157502

(51) Int. Cl.
*H01P 5/12* (2006.01)

(52) U.S. Cl. ..... 333/125; 333/136

(58) Field of Classification Search ..... 333/128, 333/136, 125, 137

See application file for complete search history.

(56) References Cited

U.S. PATENT DOCUMENTS 3,267,394 A * 8/1966 Peil et al. ..... 333/136
4,310,814 A * 1/1982 Bowman ..... 333/121
4,688,004 A 8/1987 Hirai et al.
5,061,943 A 10/1991 Rammos
5,489,880 A * 2/1996 Swarup ..... 333/128
5,966,293 A * 10/1999 Obermaier et al. ..... 361/735
6,005,454 A * 12/1999 Kim ..... 333/128
6,201,439 B1 * 3/2001 Ishida et al. ..... 330/124 R
6,335,662 B1 * 1/2002 Del Rosario et al. ..... 333/111
6,570,466 B1 * 5/2003 Bahl ..... 333/128

FOREIGN PATENT DOCUMENTS

JP 09-018206 1/1887
JP 03-019722 3/1991
JP 04-123607 11/1992

(Continued)

OTHER PUBLICATIONS

Antenna Engineering Handbook; Japan; Ohmsha, Ltd; Mar. 5, 1999; 1st Edition, 10th Printing, 16 pages.

*Primary Examiner*—Benny Lee
(74) *Attorney, Agent, or Firm*—Foley & Lardner LLP

(57) ABSTRACT

A power distribution and combination circuit for distributing a signal input from a first port to a second and third ports and combining signals input from the second and the third port so as to be outputted to the first port. A transmission line of the power distribution and combination circuit has a first end connected to a power (the first port) and a second end connected to the second and third ports for distributing and combining the input signals. A second transmission line has a first end connected directly to the second end of the transmission line and a second end connected to the third port so as to be unified with the transmission line.

11 Claims, 3 Drawing Sheets

FOREIGN PATENT DOCUMENTS

| | | | |
|---|---|---|---|
| JP | 06-224643 | | 8/1994 |
| JP | 07-112127 | | 11/1995 |
| JP | 11-127004 | | 5/1999 |
| JP | 11-136011 | | 5/1999 |
| JP | 2000-278010 | A | 10/2000 |
| JP | 2000-278010 | A | 10/2000 |
| JP | 2001-196816 | A | 7/2001 |
| JP | 2002-141714 | A | 5/2002 |
| JP | 2003-101313 | A | 4/2003 |
| JP | 2003-101314 | A | 4/2003 |

* cited by examiner

POWER DIVIDER-COMBINER CIRCUIT

TECHNICAL FIELD

The present invention relates to a power divider-combiner circuit having a first input-output (I/O) port at one end and second and third I/O ports at the other end. In the power divider-combiner circuit, a signal input through the first I/O port is divided between the second and third I/O ports. Signals input through the second and third I/O ports are combined with each other and the combined signal is output through the first I/O port.

BACKGROUND ART

Heretofore, power divider-combiner circuits of this type have often been adopted in high-frequency power amplifiers or mixer circuits requiring division and combination of power.

For example, Japanese Unexamined Patent Application Publication No. 11-127004 discloses a compact high-frequency circuit having a superior amplitude balance. However, this high-frequency circuit is not preferable because a reduction in occupied area is required for downsizing.

The high-frequency circuit disclosed in the publication is shown in, for example, FIG. 1. One end of a power divider-combiner 21 shown in FIG. 1 is connected to an I/O port P1, and the other end of the power divider-combiner 21 is connected to I/O ports P2 and P3 via transmission lines 22 and 23, respectively.

Each of the three I/O ports P1 to P3 has an I/O impedance of 50 Ω, and each of the transmission lines 22 and 23 has a characteristic impedance of 50 Ω. The line length δ of the transmission line 22 differs from the line length (δ+θ) of the transmission line 23 by an amount θ and the difference θ in line length corresponds to a difference in electrical length. In a drawing shown in the publication, a resistor 24 is connected in series to the transmission line 22, as in FIG. 1. As also shown in the drawing (e.g., see α of FIG. 1) and described in the publication, the power divider-combiner 21 generates a phase difference of α (in degrees) between its two outputs.

In this structure, a signal input through the I/O port P1 is divided into two signal components (one having a phase equal to 0 and the other having a phase equal to −α) by the power divider-combiner 21 and the output is halved. One of the signal components (the one having the phase equal to 0), having the halved output, is supplied to the I/O port P2 through the transmission line 22. The other of the signal components (the one having the phase equal to −α) is supplied to the I/O port P3 through the transmission line 23. The transmission line 22 differs from the transmission line 23 in the line length by the amount θ. Accordingly, the phase of the signals through the transmission line 22 is shifted from that of the signals through the transmission line 23 by an amount corresponding to the difference θ in electrical length while the signals of the same size are supplied to the I/O ports P2 and P3. For example, if "θ" is equal to zero, the phase difference becomes zero. If "θ" is equal to ¼ of a wavelength λ of the signals, the phase difference becomes 90°. If "θ" is equal to ½ of the wavelength λ of the signals, the phase difference becomes 180°.

In contrast, the signals input through the I/O ports P2 and P3 are supplied to the power divider-combiner 21 through the transmission lines 22 and 23 and are combined with each other by the power divider-combiner 21, and the combined signal is output through the I/O port P1.

Although the power divider-combiner 21 of a Wilkinson type is ordinarily used, the power divider-combiner 21 of a branch-line type or of a rat-race type may be used depending on the application.

The resistor 24 provided in FIG. 1 compensates for the difference in the resistances of the transmission lines in the division to eliminate differences in transmission loss and in amplitude. As a result, the circuit having a superior balance is realized.

The power divider-combiner circuit having the above structure occupies a larger area in the amplifier and, therefore, is inevitably expensive, regardless of the Wilkinson circuit, the branch-line circuit, or the rat-race circuit. This is because, for example, even the Wilkinson circuit having the smallest occupied area has transmission lines having an electrical length that is at least "half" of the wavelength λ of the signals. Furthermore, since the resistor and the transmission lines for adjusting the differences in amplitude and phase are provided, the circuit inevitably has a larger size.

In order to resolve the above problems, an object of the present invention is to provide a power divider-combiner circuit which has a simple structure in order to reduce in size and which is capable of realizing a reduction in cost.

SUMMARY OF THE INVENTION

A power divider-combiner circuit according to the present invention divides a first input signal into first and second divided signals, and combines second and third input signals and outputs the combined signal. The power divider-combiner circuit includes a first port (P1) through which the first input signal is input, a second port (P2), a third port (P3), and a transmission line unit (11+12). The transmission line unit is integrally formed, is connected to the first, second, and third ports, divides the first input signal input through the first port into the first and second divided signals, and outputs the first and second divided signals through the second and third ports. The transmission line unit combines the second and third input signals when the second and third input signals are input through the second and third ports, and outputs the combined signal through the first port.

The transmission line unit desirably includes a first transmission line (11) having a first end (1) connected to the first port and a second end (2) AC-connected to the second port, and a second transmission line (12) having one end connected to the second end of the first transmission line and the other end (3) AC-connected to the third port.

Accordingly, making the electrical length of the first transmission line a quarter of a waveform λ of the signals allows all of the three I/O ports to have the same I/O impedance. In addition, connecting a transmission line having an electrical length that is half of the wavelength λ of the signals to one of the two I/O ports at one end of the transmission line allows the difference in phase after the division to become 180°. Connecting a transmission line having an electrical length that is a quarter of the wavelength λ of the signals allows the difference in phase after the division to become 90°.

Since the first transmission line is integrated with the second transmission line and the first and second transmission lines are microstrip lines formed on a substrate, a further reduction in size can be achieved.

As described above, since providing only one or two transmission lines for the three I/O ports can form the power divider-combiner circuit, it is possible to simplify the circuit and the manufacturing of the circuit to reduce in size and in cost. In addition, the amplitude can be equally divided and the difference in phase can be arbitrarily changed in the division, and the circuit can be reduced in size to realize a reduction in cost.

BEST MODE FOR CARRYING OUT THE INVENTION

Embodiments of the present invention will be described in detail with reference to the attached drawings.

Figure 1:
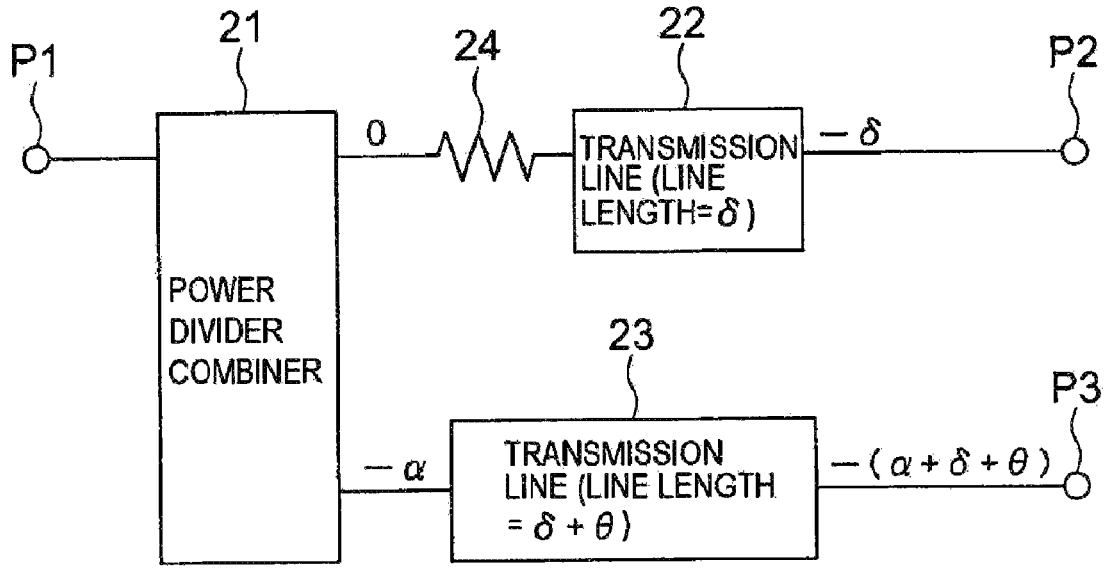
FIG. 1 Prior Art
FIG. 1 is a functional block diagram showing a known example.
Figure 2:
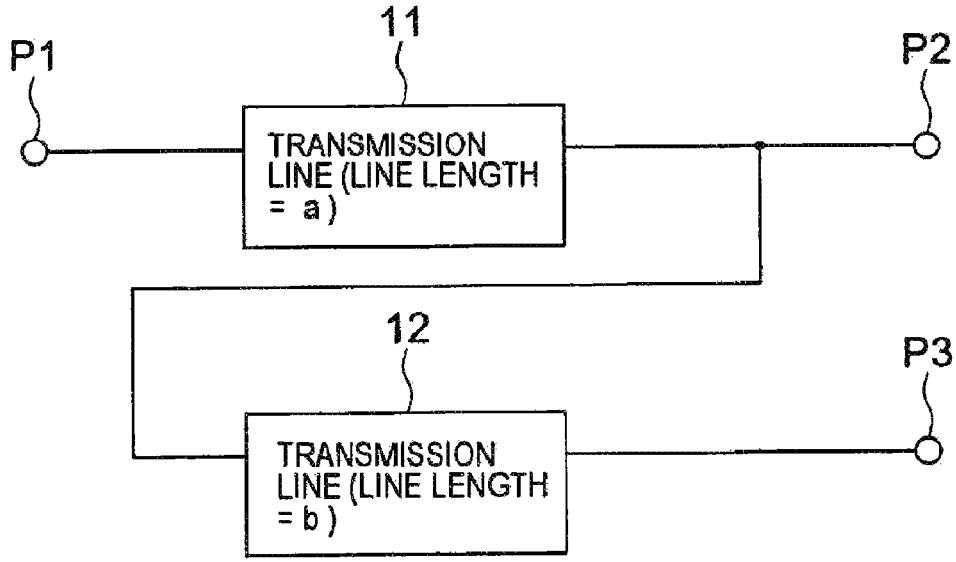
FIG. 2 is a functional block diagram showing an embodiment of the present invention.

FIG. 2 is a functional block diagram showing an embodiment of the present invention. In a power divider-combiner circuit shown in FIG. 2, two transmission lines 11 and 12 are provided for three I/O ports P1, P2, and P3.

The transmission line 11 functions as a first transmission line and has a line length a. One end of the transmission line 11 is connected to the I/O port P1 and the other end thereof is connected to the I/O port P2. The transmission line 12 functions as a second transmission line and has a line length b. One end of the transmission line 12 is directly connected to the I/O port P2 and the other end thereof is connected to the I/O port P3.

A signal input through the first 110 port P1 is divided into two signal components at the other end of the transmission line 11, connected to the second I/O port P2. One of the signal components is supplied to the I/O port P2. The other of the signal components is supplied to the third I/O port P3 through the transmission line 12. The amplitude of the signals supplied to the I/O ports P2 and P3 is equally divided because the transmission line 12 has the electrical length b, whereas the phase of the signals is shifted from a wavelength λ of the signals by an amount "b/λ". If the electrical length b of the transmission line 12 is equal to "λ/2", the phase difference of the signals after the division becomes 180°. If the electrical length b is equal to "λ/4", the phase difference of the signals after the division becomes 90°.

Changing the electrical length b of the transmission line 12 in the manner described above allows signals having an arbitrary phase difference to be output between the I/O ports P2 and P3. If the electrical length a of the transmission line 11 is equal to "λ/4", the transmission line 11 functions as an impedance converter. For example, on the assumption that the I/O ports P1 to P3 each have an I/O impedance Z0 and the transmission line 12 has a characteristic impedance Z0, the characteristic impedance of the transmission line 11 having the line length "λ/4" is given by "dividing the characteristic impedance of the transmission line 12 by a square root", that is, is uniquely determined as "Z0/√2".

An exemplary structure of a power divider-combiner circuit 10 according to an embodiment of the present invention will be described with reference to FIG. 3.

A transmission line 11 has a line length a. One end 1 of the transmission line 11 is connected to an I/O port P1 via a conductive line, and the other end 2 thereof is connected to an I/O port P2 via, for example, a capacitor 13 and a conductive line. A transmission line 12 has a line length b. One end of the transmission line 12 is directly connected to the other end 2, and the other end 3 thereof is connected to an I/O port P3 via, for example, a capacitor 14 and a conductive line.

A signal input through the I/O port P1 is divided into two signal components at the other end 2 of the transmission line 11. One of the signal components is supplied to the I/O port P2 and the other of the signal components is supplied to the I/O port P3 through the transmission line 12.

The ends 1 to 3 connected to the I/O ports P1 to P3, respectively, each have an I/O impedance Z0. The line length a of the transmission line 11 shown in FIG. 3 is equal to "¼" of the wavelength λ of the used frequency and the line length b of the transmission line 12 is equal to "½" of the wavelength λ of the used frequency. In this case, the characteristic impedance of the transmission line 11 becomes "Z0/√2" and the characteristic impedance of the transmission line 12 becomes "Z0". The signal input through the I/O port P1 under these conditions is divided at the other end 2 of the transmission line 11, and the amplitude of the signal is equally divided between the I/O ports P2 and P3.

Figure 3:
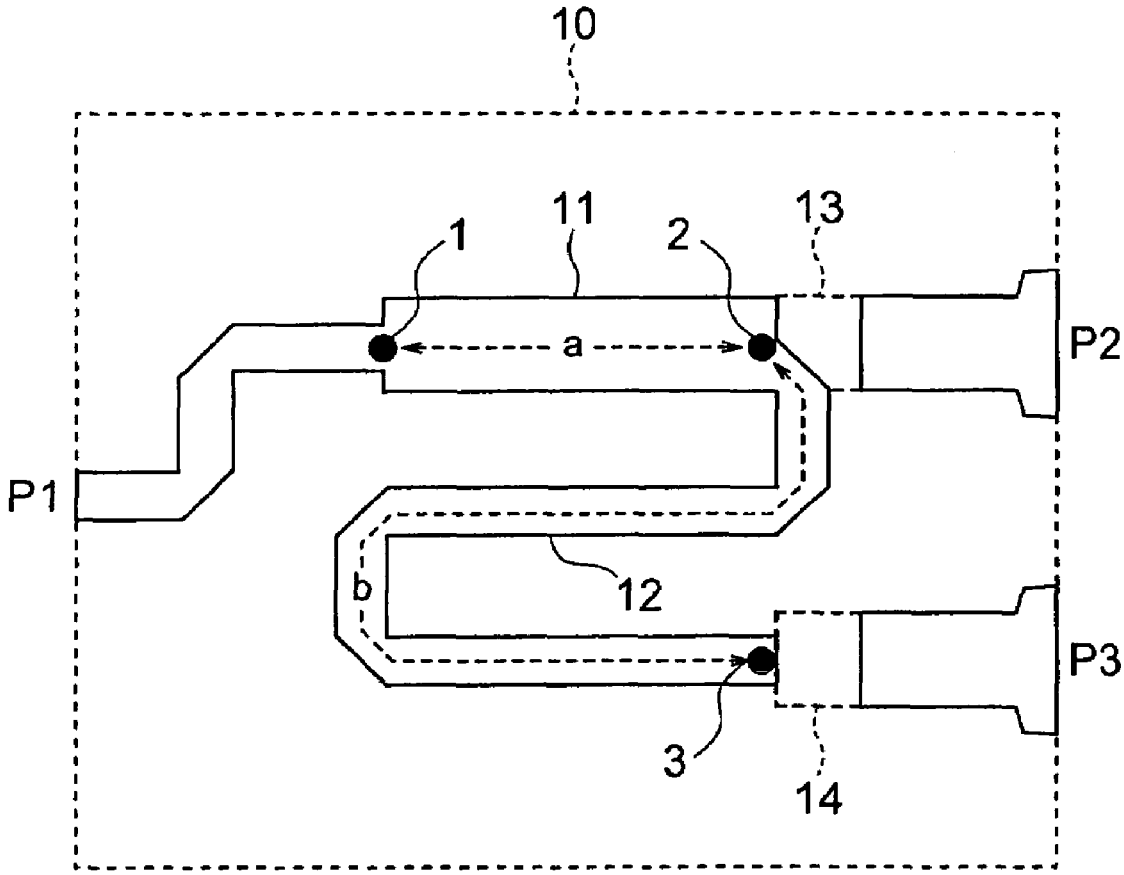
FIG. 3 is a diagram showing an embodiment embodying a circuit in FIG. 2 on a substrate.

In addition, in the power divider-combiner circuit 10 shown in FIG. 3, the transmission lines 11 and 12 are microstrip lines integrally formed on a substrate as a transmission line unit, The substrate realizing the microstrip lines is, for example, an alumina substrate or a Teflon® substrate.

Figure 4:
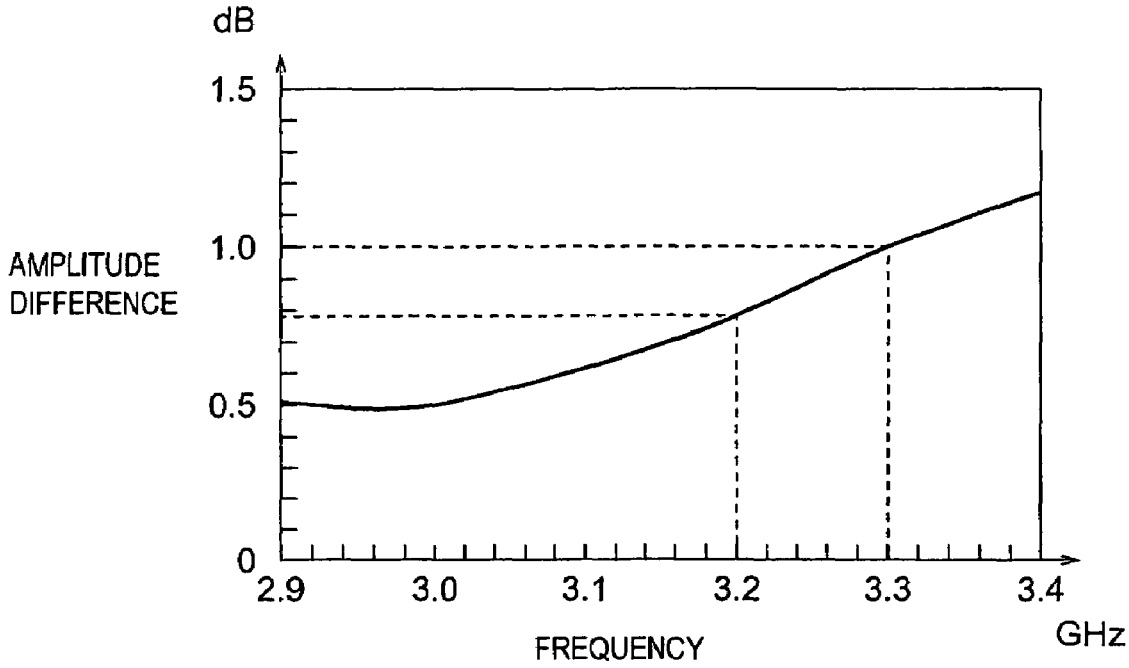
FIG. 4 is a graph showing differences in amplitude with respect to the frequency, measured based on FIG. 3.
Figure 5:
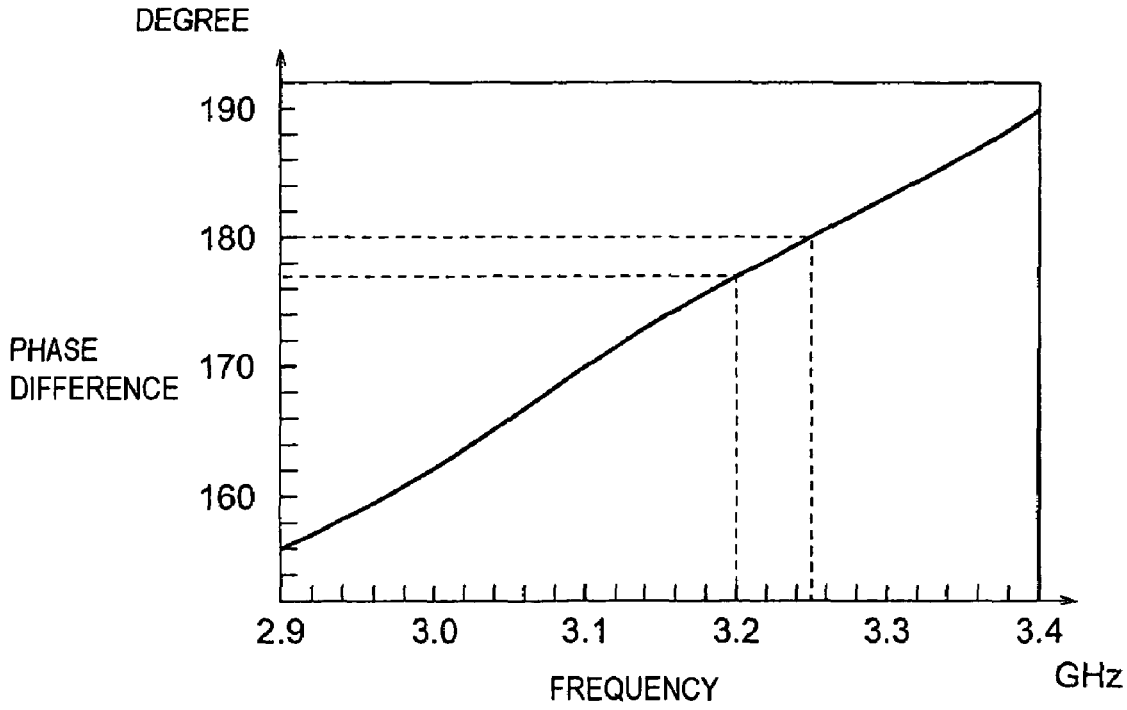
FIG. 5 is a graph showing differences in phase with respect to the frequency, measured based on FIG. 3.

FIGS. 4 and 5 show transmission characteristics resulting from the signal transmission with the power divider-combiner circuit 10 shown in FIG. 3.

FIG. 4 shows data in a case where a signal input through the I/O port P1 is output through the I/O ports P2 and P3. In the graph in FIG. 4, the differences in amplitude (in dB) of the signals between the I/O ports P2 and P3 are shown with respect to the frequency. The graph shows that the center frequency is 3.2 GHz and that the differences in amplitude are not more than 1 dB in a frequency range from 2.9 GHz to 3.3 GHz.

FIG. 5 shows data in a case where a signal input through the I/O port P1 is output through the I/O ports P2 and P3. In the graph in FIG. 5, the differences in phase (in degrees) of the signals between the I/O ports P2 and P3 are shown with respect to the frequency. The graph shows that the center frequency is 3.2 GHz and that the differences in phase become 180° near the center frequency 3.2 GHz.

As described above, according to the present invention, it is possible to equally divide the amplitude and to arbitrarily change the difference in phase in the division and is also possible to reduce in size of the circuit to realize a reduction in cost.

INDUSTRIAL APPLICABILITY

The power divider-combiner circuit according to the present invention is used for dividing and combining power and is applicable not only to a power amplifier but also to a divider-combiner circuit, such as a mixer.

The invention claimed is:

1. A power divider-combiner circuit that divides a first signal input to a first port to produce a first divided signal and a second divided signal and outputs the first and second divided signals to a second port and a third port, respectively, and that combines a second signal and a third signal input to the second and third ports, respectively, to produce a combined signal and outputs the combined signal to the first port, wherein the power divider-combiner circuit includes a first transmission line having a predetermined line length and a second transmission line, wherein the first port is connected to the first transmission line at a first end of the first transmission line and the second port is AC-connected to the first transmission line at a second end of the first transmission line, wherein a first end of the second transmission line is connected to the first transmission line at the second end of the first transmission line, and wherein the third port is AC-connected to the second transmission line at a second end of the second transmission line, wherein the first transmission line has an electrical length that is a quarter of a wavelength λ of the first signal, and wherein the second transmission line has an electrical length that is half of the wavelength λ of the first signal.

2. A power divider-combiner circuit that divides a first signal input to a first port to produce a first divided signal and a second divided signal and outputs the first and second divided signals to a second port and a third port, respectively, and that combines a second signal and a third signal input to the second and third ports, respectively, to produce a combined signal and outputs the combined signal to the first port, wherein the power divider-combiner circuit includes a first transmission line having a predetermined line length and a second transmission line, wherein the first port is connected to the first transmission line at a first end of the first transmission line and the second port is AC-connected to the first transmission line at a second end of the first transmission line, wherein a first end of the second transmission line is connected to the first transmission line at the second end of the first transmission line, and wherein the third port is AC-connected to the second transmission line at a second end of the second transmission line, and wherein a first connection that connects the first transmission line and the first port is free of resistors, and wherein a second connection that connects the second transmission line and the second port is free of resistors.

3. The power divider-combiner circuit according to claim 2 wherein the second transmission line has an electrical length that is a quarter of a wavelength λ of the first signal.

4. The power divider-combiner circuit according to claim 2 wherein the first transmission line has an electrical length that is a quarter of a wavelength λ of the first signal.

5. The power divider-combiner circuit according to claim 4, wherein the second transmission line has an electrical length that is a quarter of the wavelength λ of the first signal.

6. A power divider-combiner comprising:

a first transmission line having a first end and a second end;

a second transmission line having a first end and a second end, the first end of the second transmission line connected to the second end of the first transmission line;

a first port connected to the first transmission line at the first end of the first transmission line;

a second port connected to the first transmission line at the second end of the first transmission line; and a third port connected to the second transmission line at the second end of the second transmission line, wherein the power divider-combiner is configured to divide a first signal input to the first port to produce a first divided signal and a second divided signal and to output the first and second divided signals to the second port and the third port, respectively, wherein the power divider-combiner is configured to combine a second signal and a third signal input to the second and third ports, respectively, to produce a combined signal and to output the combined signal to the first port, and wherein a first connection that connects the first transmission line and the first port is free of resistors, and wherein a second connection that connects the second transmission line and the second port is free of resistors.

7. The power divider-combiner according to claim 6, wherein the first transmission line has an electrical length equal to one quarter of a wavelength λ of the first signal.

8. A power divider-combiner circuit that divides a first signal input to a first port to produce a first divided signal and a second divided signal and outputs the first and second divided signals to a second port and a third port, respectively, and that combines a second signal and a third signal input to the second and third ports, respectively, to produce a combined signal and outputs the combined signal to the first port, wherein the power divider-combiner circuit includes a first transmission line having a predetermined line length and a second transmission line, wherein the first port is connected to the first transmission line at a first end of the first transmission line and the second port is AC-connected to the first transmission line at a second end of the first transmission line, wherein a first end of the second transmission line is connected to the first transmission line at the second end of the first transmission line, and wherein the third port is AC-connected to the second transmission line at a second end of the second transmission line, and wherein the second transmission line has an electrical length that is half of a wavelength λ of the first signal.

9. The power divider-combiner circuit according to claim 8, wherein the first transmission line is integrated with the second transmission line.

10. The power divider-combiner circuit according to claim 8, wherein the first and second transmission lines are microstrip lines positioned on a substrate.

11. A power divider-combiner comprising:

a first transmission line having a first end and a second end;

a second transmission line having a first end and a second end, the first end of the second transmission line connected to the second end of the first transmission line;

a first port connected to the first transmission line at the first end of the first transmission line;

a second port connected to the first transmission line at the second end of the first transmission line; and a third port connected to the second transmission line at the second end of the second transmission line, wherein the power divider-combiner is configured to divide a first signal input to the first port to produce a first divided signal and a second divided signal and to output the first and second divided signals to the second port and the third port, respectively, wherein the power divider-combiner is configured to combine a second signal and a third signal input to the second and third ports, respectively, to produce a combined signal and to output the combined signal to the first port, and wherein the second transmission line has an electrical length equal to one half of a wavelength λ of the first signal.

* * * * *